US009580235B2

(12) United States Patent
Rondelli

(10) Patent No.: US 9,580,235 B2
(45) Date of Patent: Feb. 28, 2017

(54) INTERCHANGEABLE CAPSULE FOR PREPARING AN INFUSION OF COFFEE, AND METHOD FOR OBTAINING AN INFUSION OF SAID COFFEE

(75) Inventor: Raffaele Rondelli, Argelato (IT)

(73) Assignee: MACCHIAVELLI S.R.L., San Lazzaro di Savena (IT)

( * ) Notice: Subject to any disclaimer, the term of this patent is extended or adjusted under 35 U.S.C. 154(b) by 815 days.

(21) Appl. No.: 14/002,906

(22) PCT Filed: Mar. 2, 2012

(86) PCT No.: PCT/IB2012/051012

§ 371 (c)(1),
(2), (4) Date: Dec. 9, 2013

(87) PCT Pub. No.: WO2012/117383

PCT Pub. Date: Sep. 7, 2012

(65) Prior Publication Data

US 2014/0161937 A1 Jun. 12, 2014

(30) Foreign Application Priority Data

Mar. 2, 2011 (IT) ..... BO2011A0101

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

FOREIGN PATENT DOCUMENTS

| | | | |
|---|---|---|---|
| AU | 2012222889 | A1 | 4/2013 |
| DE | 10 2009 007 553 | A1 | 8/2010 |
| EP | 1 440 908 | A1 | 7/2004 |
| EP | 1739060 | A1 | 1/2007 |
| EP | 1 775 234 | A1 | 4/2007 |
| EP | 1 826 148 | A1 | 8/2007 |
| EP | 2 030 915 | A2 | 3/2009 |
| EP | 2 230 195 | A1 | 9/2010 |

OTHER PUBLICATIONS

International Search Report in international application No. PCT/IB2012/051012, dated May 21, 2012.
Third Party Observation in EPO counterpart application No. 12713327.0 (publication No. EP2681135), dated Nov. 28, 2013.

*Primary Examiner* — Erik Kashnikow
*Assistant Examiner* — Chaim Smith
(74) *Attorney, Agent, or Firm* — Marshall, Gerstein & Borun LLP

(57) ABSTRACT

A capsule suited to contain in its inside a mass of powdered coffee for preparing an infusion of coffee. The capsule comprises a container closed by a lid. The container is provided with a filter of the coffee/hot water infusion. The capsule is characterized in that the mass of powdered coffee is located in an annular space surrounding a central chimney. The infusion water, during at least one of its intermediate steps, converges from the annular space towards the central chimney passing first through a vertical filter.

6 Claims, 6 Drawing Sheets

INTERCHANGEABLE CAPSULE FOR PREPARING AN INFUSION OF COFFEE, AND METHOD FOR OBTAINING AN INFUSION OF SAID COFFEE

CROSS-REFERENCE TO RELATED APPLICATIONS

This is the U.S. national phase of International Application No. PCT/IB2012/051012, filed Mar. 2, 2012, which claims the benefit of Italian patent application No. B02011A000101, filed Mar. 2, 2011.

TECHNICAL FIELD

The present invention relates, first of all, to an interchangeable capsule for preparing an infusion of coffee, in particular of American-style coffee, from a powdered product. The invention also relates to an innovative method for preparing an infusion of coffee, in particular of American-style coffee.

Let it be said that, although the present invention has advantageously, but not exclusively, application to the interchangeable capsules for preparing an infusion of American-style coffee (which the following description will make explicit reference to without thereby losing generality), the teachings of the present invention can be applied to any type of interchangeable capsule for coffee, for example to the interchangeable capsules for espresso coffee.

BACKGROUND ART

As is known, being defined as "American-style coffee" is an infusion achieved by the use of a particular machine where the hot water passes through a filter which contains unpressed ground coffee and is deposited by gravity into a carafe below.

The coffee that is used for preparing such a beverage is different from that used in moka or Italian espresso machines for the fact of being milled in a more coarse way and not subject to any pre-compression when in the capsule.

There are commercially available machines specially made for preparing American-style coffee, which are characterized by a very simple operation.

In fact, said machines have a water tank, a pump which sends the heated water in a small container with a paper filter containing coffee therein. The hot water submerges the coffee and, passing through the filter paper, falls by gravity into an appropriate carafe below suited for maintaining the beverage hot for a long time since it is heated by a specific electrical warming plate.

In addition to the traditional American-style coffee-makers, wherein the bowl-shaped filter is hand filled by the user, capsules have recently appeared on the market presenting an outer casing wherein a paper filter partially filled with unpressed coffee is inserted.

By means of special percolator machines the lid and the bottom in plastic material are perforated so as to create a flow of hot water that infuses with the coffee powder.

However, the American-style coffee capsules currently on the market do not work reliably. In fact, usually providing only a filter arranged at the bottom, the incoming hot water is induced to flow along substantially vertical preferential fluid threads, which, therefore, do not affect the whole mass of ground coffee contained in the capsule.

DISCLOSURE OF INVENTION

Therefore, the main object of the present invention is to provide an interchangeable coffee capsule which is free from the abovementioned disadvantages.

Further object of the present invention is to provide an innovative method for obtaining coffee.

According to the present invention is made, therefore, an interchangeable capsule, as claimed in claim 1 or in any of the claims depending directly or indirectly on claim 1.

Consistently according to the principles of the present invention an innovative method for obtaining coffee is provided as claimed in claim 8 or in any of the claims depending directly or indirectly on claim 8.

BRIEF DESCRIPTION OF THE DRAWINGS

For a better understanding of the invention an embodiment purely by way of illustration and not of limitation is described below with the aid of the accompanying drawings, wherein.

BEST MODE FOR CARRYING OUT THE INVENTION

Figure 1:
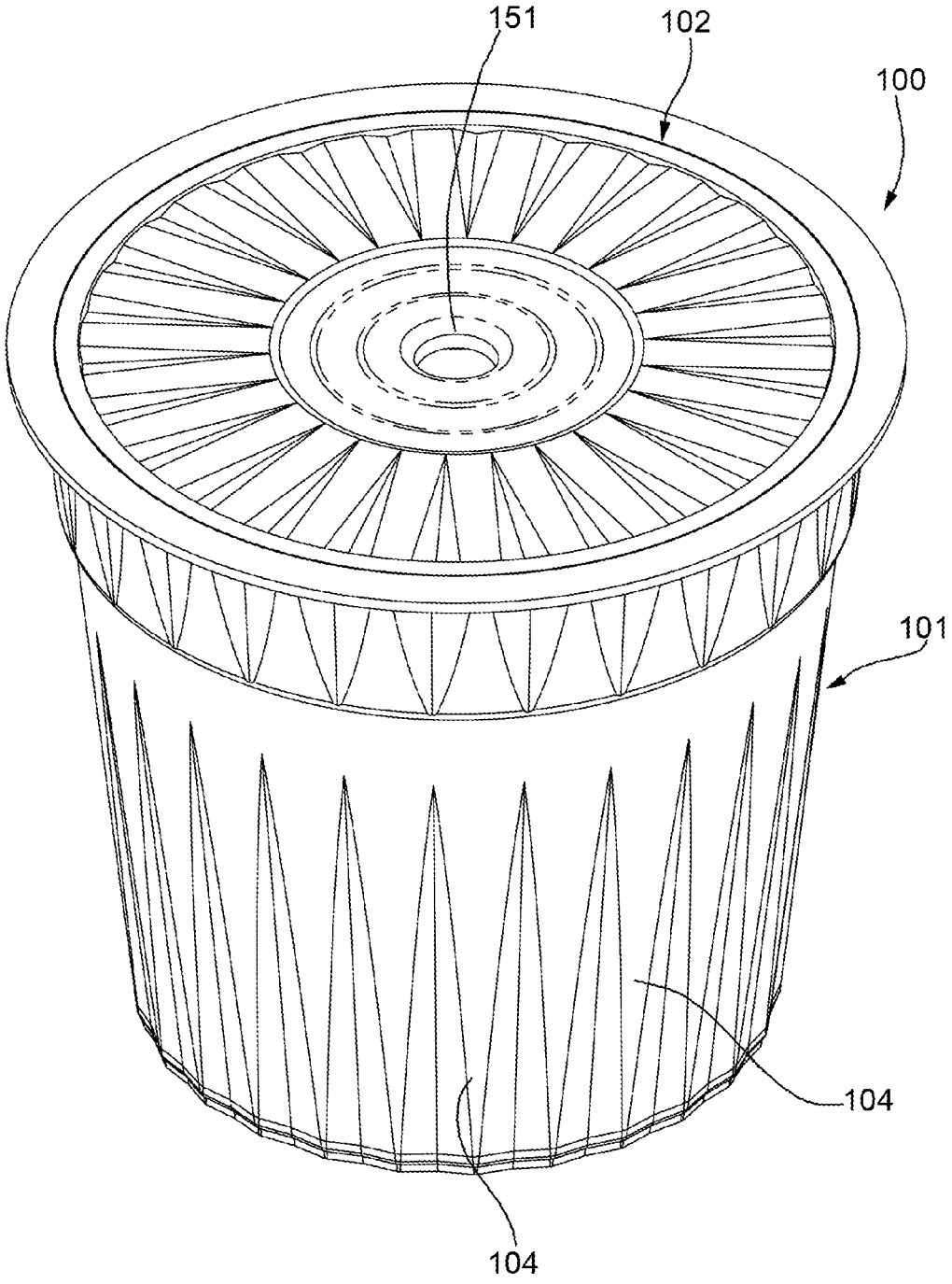
FIG. 1 shows a three dimensional view of an interchangeable coffee capsule according to the present invention.

In FIGS. 1-5 a preferred embodiment has been illustrated of an interchangeable capsule 100 in accordance with the teaching of the present invention.

The interchangeable capsule 100 is suited to contain in its inside a certain amount of powdered coffee for the preparation of American-style coffee according to the definition given above.

The interchangeable capsule comprises a container 101 closed by a lid 102 by known systems.

The container 101 comprises, in turn, a side wall 105, of substantially frusto-conical shape and of longitudinal axis of symmetry (Y).

At a first end 101A of the container 101 protrudes a support edge 103 of a circular crown shape, to ensure that the entire container 101 can be received in a special receptacle formed in an American-style coffee machine (not shown). Preferably, but not necessarily, the side wall 105 and the relative support edge 103 are made in one piece with a plastic material suitable for food of a known type.

The outer surface of the side wall 105 could also present ribs 104 (FIG. 1), so as to strengthen the structure of the side wall 105 itself.

As again shown in FIG. 1, near a second end 101B of the container 101 is provided a chamber 110 preferably made from the withdrawing of the bottom of the container 101 itself.

In the present case the chamber 110 is of substantially frusto-conical shape and is defined by a side wall 111 as well as by a first bottom 112 substantially in the shape of a circular crown.

Figure 2:
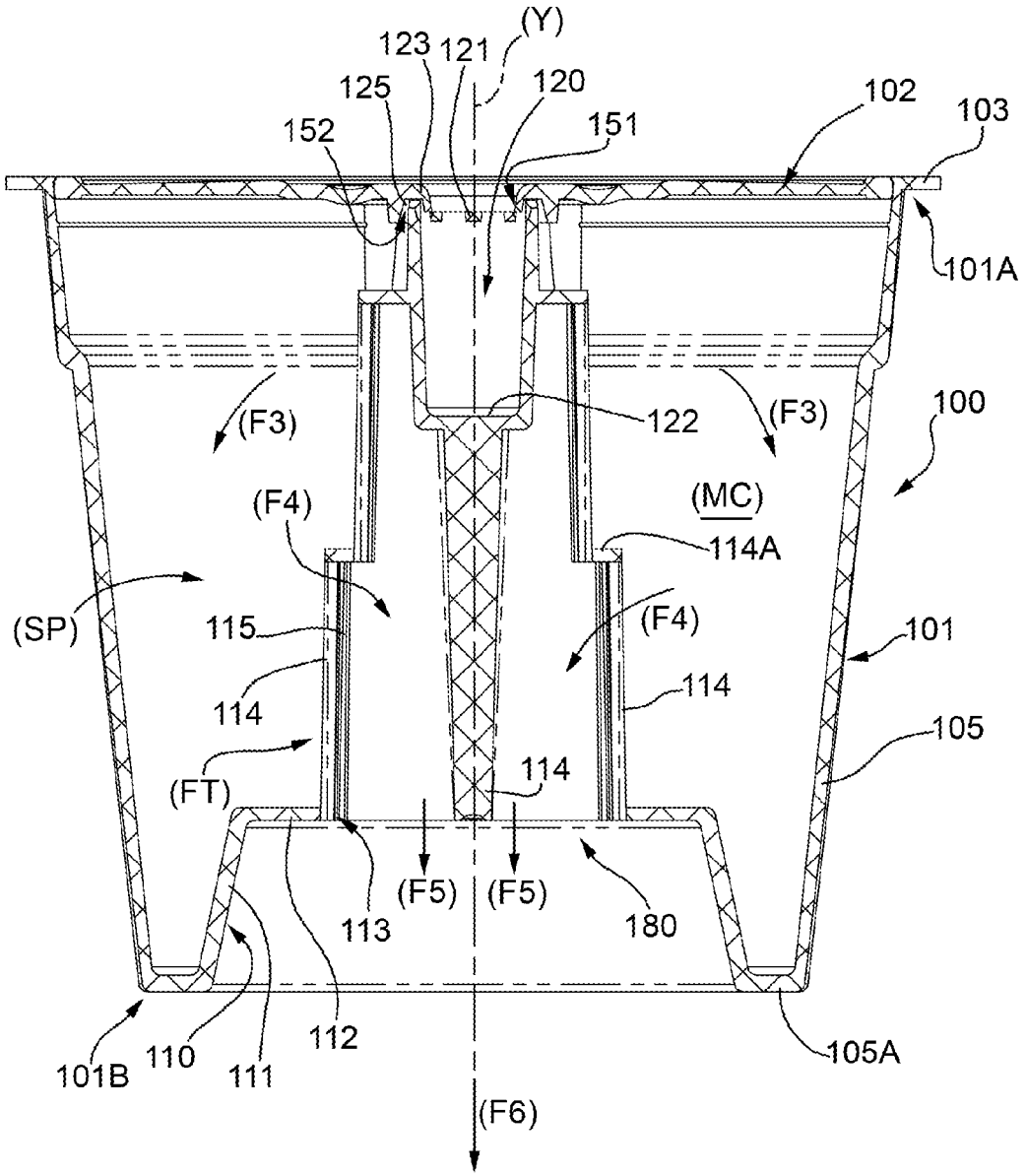
FIG. 2 shows a first longitudinal section of the capsule of FIG. 1.
Figure 3:
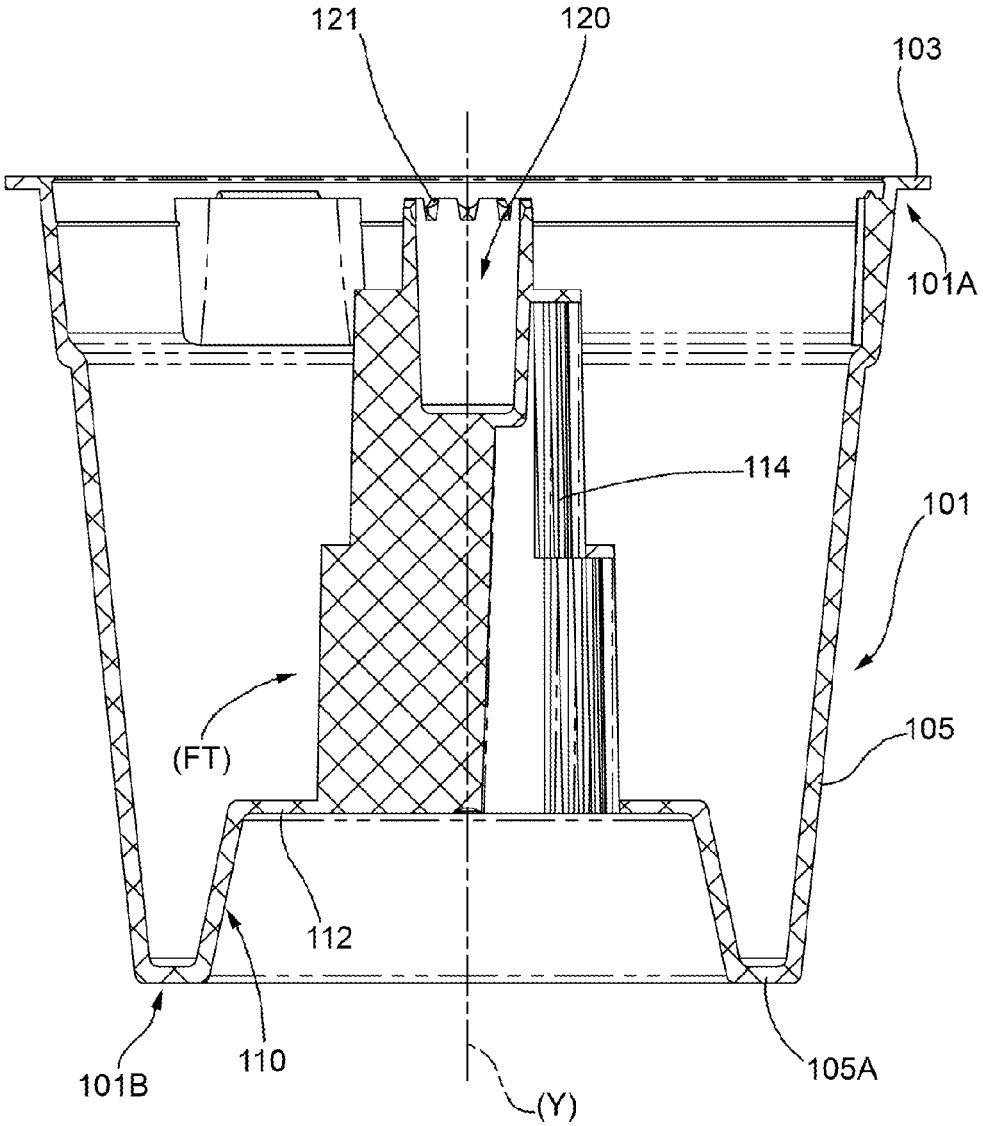
FIG. 3 shows a longitudinal section of a container belonging to the capsule of FIG. 1.
Figure 4:
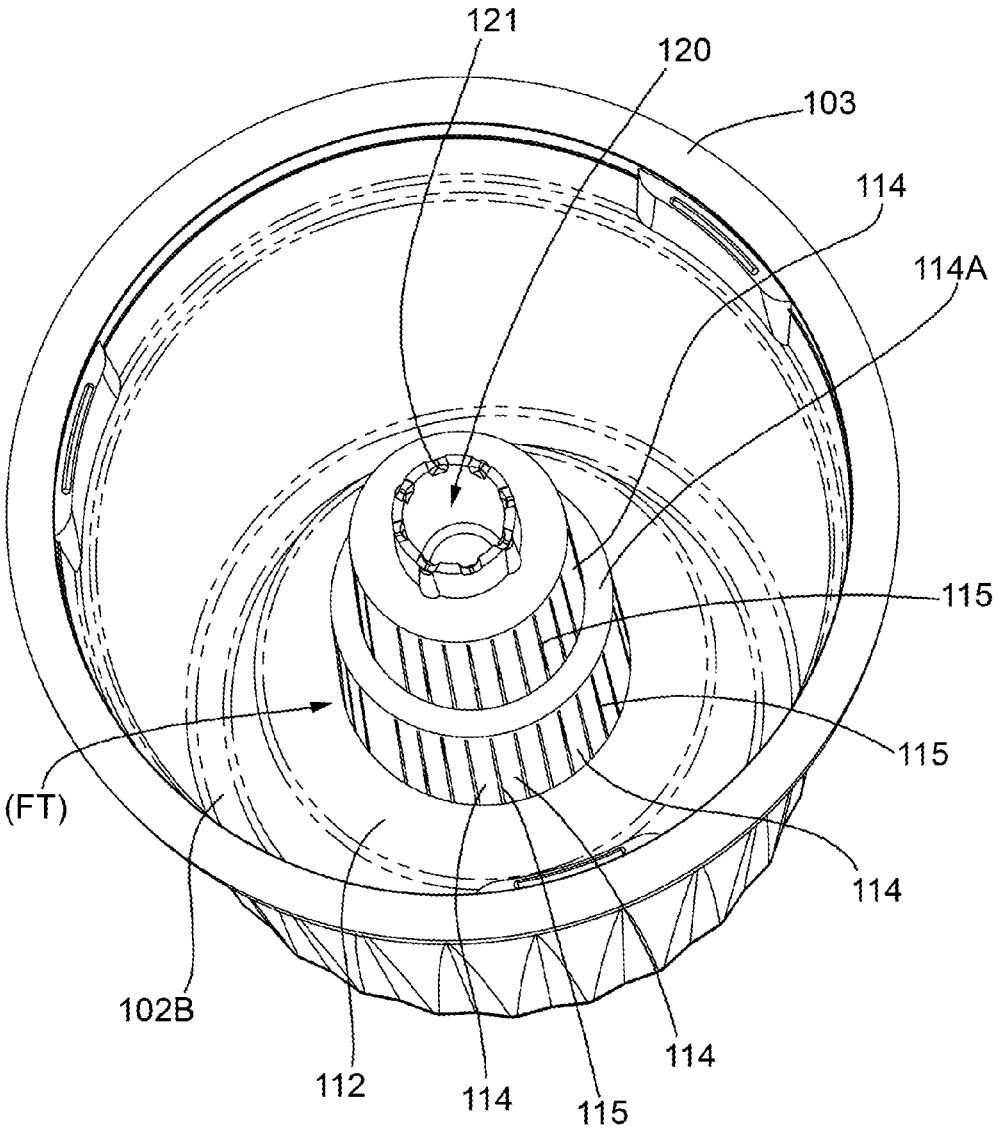
FIG. 4 shows a three dimensional view from above of a coffee container belonging to the capsule of FIG. 1.
Figure 5:
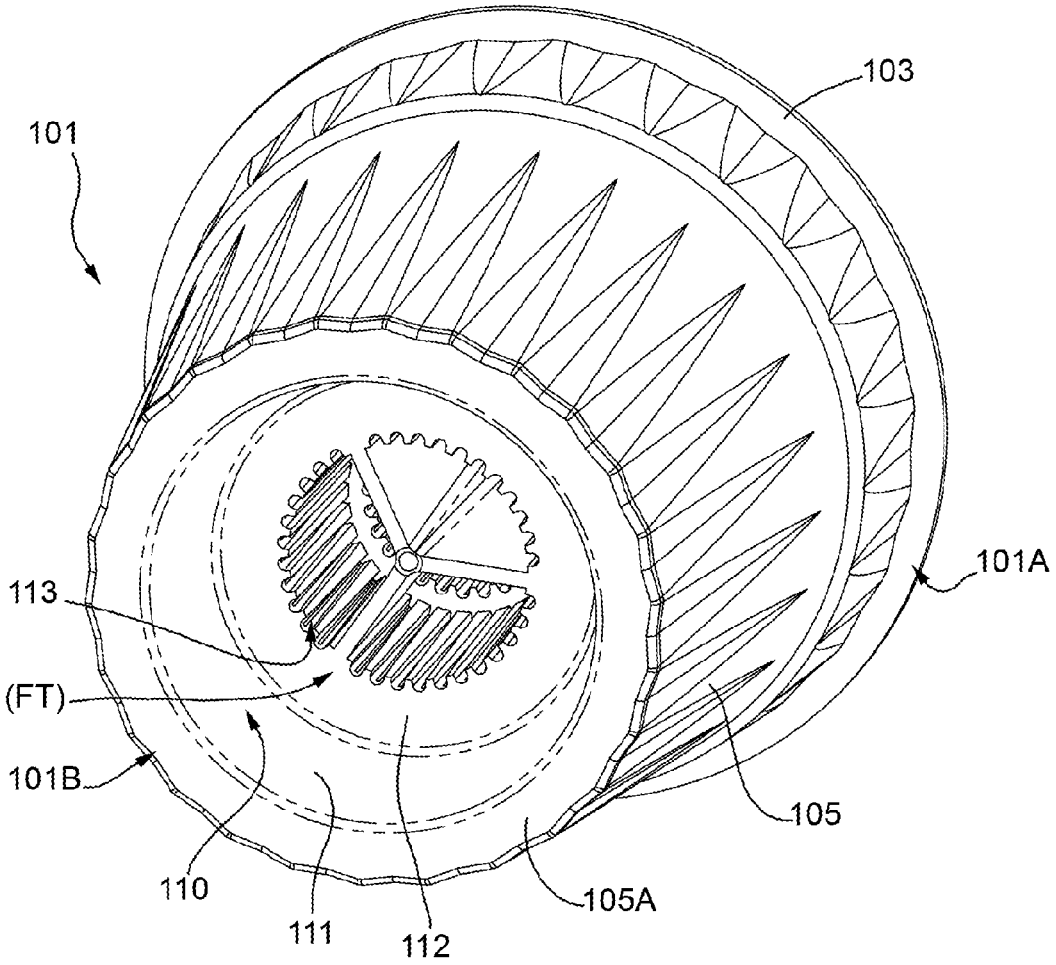
FIG. 5 shows a three dimensional view from the bottom of the container of FIG. 4.

The container 101 is closed in its lower part by a second bottom 105A which is also in the shape of a circular crown. The second bottom 105A lies on a plane parallel to the resting plane of the first bottom 112 (FIG. 2).

The first bottom 112 is further provided with a circular hole 113 whose center is located on the axis (Y). From the first bottom 112 departs upwards a plurality of vertical projections 114.

Between each couple of vertical projections 114 a relative through opening 115 is defined which allows the passage of the hot water/coffee infusion.

Obviously, the width of each through opening 115, advantageously in the form of a notch, has been calculated so as to prevent as far as possible, the passage of granules of ground coffee carried by the hot infusion.

Therefore, the set of vertical projections 114 and of the openings 115 constitutes a vertical filter (FT) suited to filter the outcoming infusion of coffee from the space (SP) and the incoming infusion of coffee in the central chimney 180.

The vertical projections 114, in turn, support a feeding well 120, which ends on the lid 102 (see below), always of axis (Y), on whose surface there are through openings 121 for the purposes that will be seen better later. The feeding well 120 is closed at the bottom by a circular base 122.

In addition, the vertical projections 114 advantageously have a stepped profile (FIG. 2), presenting, each, a step 114A.

As shown in FIG. 2, the lid 102 is provided with a through hole 151 at the feeding well 120.

Figure 6:
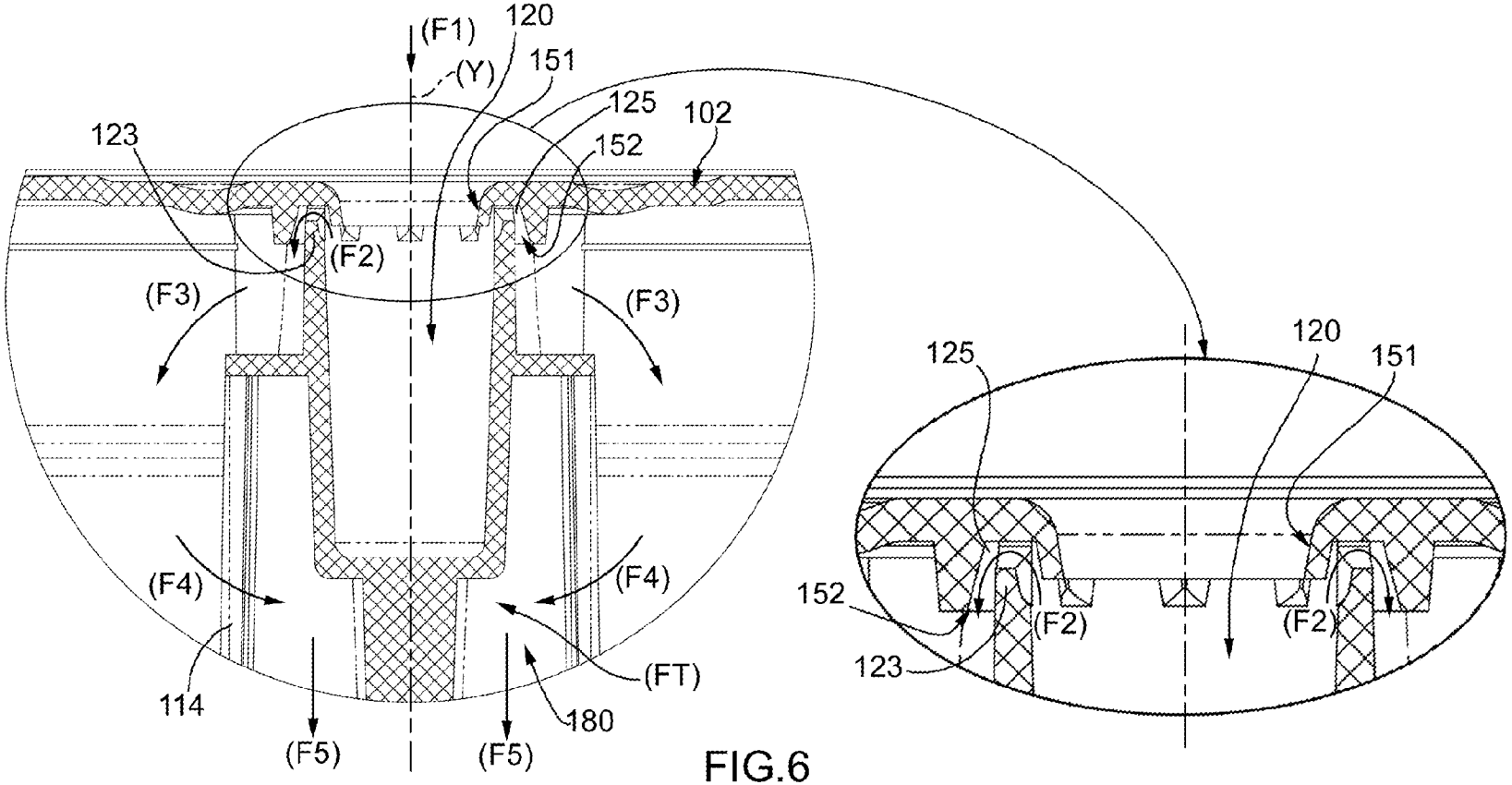
FIG. 6 (and relative magnification) shows some enlarged details of the capsule of FIG. 1.

As shown in greater detail in FIG. 6 an open annular lip 123 of the feeding well 120 is housed in an annular seat 152 provided on the inner surface of the lid 102 so as to define a labyrinth path 125 for the admission of hot water into the capsule 100 (see below).

The mass of the powdered coffee (MC) is contained, therefore, in an annular space (SP) comprised between the inner surface of the side wall 105, the outer surface of the feeding well 120, the outer surface of the vertical projections 114, as well as the outer surfaces of the side wall 111 and of the two bottoms 105A, 112.

Also note that within the container 101 is formed a central chimney 180 delimited at the top by the bottom 122, inferiorly by the bottoms 112, 105A, and laterally by the vertical projections 114 and by the side wall 111.

Please take note also that the labyrinth path 125 ensures the outflow of hot water towards the interior of the container 101, but prevents backflow of the powdered coffee from the through openings 121.

The operation of the capsule 100 of the present invention is as follows (FIGS. 2 and 6):

(a)—from the through hole 151 (arrow (F1)) of the lid 102 hot water flows injected into the feeding well 120 from a nozzle (not shown) belonging to the coffee machine (not shown);

(b)—the hot water coming from the nozzle, as the open annular lip 123 and the annular seat 152 are coupled, is forced to cross first the through openings 121 to then follow the labyrinth path 125 (arrow (F2)) and flow by gravity inside the mass of powdered coffee (MC) (arrow (F3));

(c)—the infusion then exits from the openings 115 (arrow (F4)) of the vertical filter (FT) which retains the particles of powdered coffee always within the annular space (SP);

(d) the infusion of coffee in the hot water finally converges towards the central chimney 180 (arrow (F5)) from where it then flows to a collector of a known type and not illustrated, for example a glass or a carafe (arrow (F6)).

Advantageously, but not necessarily, in a further embodiment not shown, the chamber 110 is occupied, at least partially, by an additional filter (not shown) suited to retain any of the particles of coffee that accidentally managed to pass through the openings 115 of the vertical filter (FT) carried by the flow of the infusion.

In another embodiment, not shown, the chamber 110 is occupied, at least partially, by a filtering pod filled with at least one other essence, for example, cardamom, cinnamon, ginseng etc. Therefore, the infusion of coffee in hot water, passing also through the pod below, also extracts the essence of the product contained in the pod itself.

In other embodiments, not shown, the hot water for the infusion may enter the container 101 rather than from the well 120, from at least one hole made through the lid 102 by known systems.

The present invention also relates to a method for obtaining a beverage infusion, in particular of an American-style coffee, the method is characterized by the following steps:

(f1) injecting a certain amount of hot water inside a container of ground coffee (arrow (F1));

(f2) causing the hot water to flow inside the container towards its periphery (arrow (F2));

(f3) causing the hot water to flow by gravity inside the mass of the powdered coffee arranged in an annular space (arrow (F3));

(f4) causing the infusion to pass through vertical filtering means (arrow (F4)), making it converge towards a central chimney (arrow (F5)); and (f5) causing the infusion of coffee to flow towards a collector (arrow (F6)).

The method may further comprise a further filtering step of the infusion.

Moreover, the method may comprise a further step of passage of the infusion through means containing at least one essence, as cardamom, cinnamon or ginseng.

The advantages of the disposable capsule object of the present invention are the following:

- the capsule object of the invention has, preferably, but not necessarily, a central well from which occurs the first admission of hot water coming from a single jet of the machine; the hot water is thus evenly distributed in the mass of ground coffee, this feature allows the control in a uniform and constant way of the distribution of water into the capsule itself;
- the bottom of the capsule, or rather, the bottom of the compartment that contains the coffee, is closed, and hence vertical preferential water outflows during the infusion are avoided, as instead occurs with the other capsules known on the market having a filter on the bottom or a single opening created as a result of a perforation through the bottom itself;
- the filtering area of the infusion is substantially vertical about the central chimney so as to have a larger filtration area compared to the capsules that envisage a filter for the coffee arranged only on the bottom; in addition, this vertical filtering creates an effect of turbulence improving the exploitation of the product to be infused;
- with the capsule object of the invention it is possible to convert more products by calibrating the admission of water and, the discharge of the product according to the product itself;
- the capsule is advantageously made in one piece with multiple compartments thus simplifying the packaging machine for the industrialization of the capsule itself; and the capsule object of the invention not having the characteristic of having to be perforated for its use can be packed in a bag filled with nitrogen to eliminate oxygen and to avoid the oxidation process of the product; thus differing from almost all of the capsules on the market which, between the ground product and the closed bottom, create a pocket of oxygen difficult to eliminate which is the undesired cause of the oxidation process of the ground product.

The invention claimed is:

1. A capsule for containing a mass of powdered coffee for preparing an infusion of coffee; the capsule comprising:

a container closed by a lid, said container comprising a filter for filtering a coffee/hot water infusion;

a central chimney;

an annular space surrounding the central chimney for receiving the mass of powdered coffee;

a plurality of through openings disposed in a feed well wherein during use infusion water is fed towards the mass of powdered coffee through the plurality of through openings; and a labyrinth path in fluid communication with the plurality of through openings, such that the infusion water, after passing through said plurality of through openings, flows along the labyrinth path wherein the filter comprises a first vertical filter arranged such that during at least one intermediate infusion step, infusion water converges from the annular space towards said central chimney, passing at first through said first vertical filter.

2. The capsule according to claim 1, further comprising at least one hole in the lid, wherein during use the infusion water is fed towards the mass of powdered coffee through the at least one hole.

3. The capsule according to claim 1, wherein said vertical filter comprise a plurality of vertical projections, each couple of said vertical projections being separated by a respective through opening with the shape of a groove.

4. The capsule according to claim 1, further comprising a chamber provided on the bottom of said container, wherein the chamber is at least partially provided with further filter suited to stop possible coffee particles which may accidentally have managed to pass through said vertical filter.

5. The capsule according to claim 1, further comprising a chamber provided on the bottom of said container, wherein the chamber is at least partially engaged by pod filled with an essence.

6. The capsule of claim 5, wherein the essence is cardamom, cinnamon, or ginseng.

* * * * *